US006234867B1

(12) United States Patent
Fanelli

(10) Patent No.: US 6,234,867 B1
(45) Date of Patent: May 22, 2001

(54) MASTECTOMY GARMENTS WITH BUILT-IN PROSTHETIC DEVICE

(76) Inventor: Marie Fanelli, 3 Erhle Ct., Fort Salonga, NY (US) 11768

( * ) Notice: Subject to any disclaimer, the term of this patent is extended or adjusted under 35 U.S.C. 154(b) by 0 days.

(21) Appl. No.: 09/483,255

(22) Filed: Jan. 13, 2000

(51) Int. Cl.[7] ..... A41C 3/10
(52) U.S. Cl. ..... 450/31; 450/1
(58) Field of Search ..... 450/1, 31, 32, 450/38, 54–59, 53; 2/267, 268, 455, 456, 459–467; 623/7, 8

(56) References Cited

U.S. PATENT DOCUMENTS 4,024,876 * 5/1977 Penrock ..... 450/48
5,098,330 * 3/1992 Greenberg ..... 450/55
5,334,082 * 8/1994 Barker ..... 450/31
5,782,671 * 7/1998 Suen et al. ..... 450/38
5,823,852 * 10/1998 Chu ..... 450/38

* cited by examiner

*Primary Examiner*—Gloria M. Hale
(74) *Attorney, Agent, or Firm*—John F. Vodopia

(57) ABSTRACT

A mastectomy bra is constructed with a built-in prosthetic device and includes at least one bra outer portion within which a breast-shaped prosthetic device of varying weight and composition is permanently adjusted. The single bra cup includes an outer fabric layer fully enclosing and supporting the prosthetic device, and the outer fabric layer includes a breast contoured portion and a body facing portion. The prosthetic device is formed in a natural shape of a woman's breast. The device is also constructed of a non-permeable, soft flexible outer shell layer within which is disposed the fluid-like material. An optional valve may be included for adding or removing fluid material from the bra cup for aesthetic adjustment of its size.

14 Claims, 8 Drawing Sheets

FIG. 6A
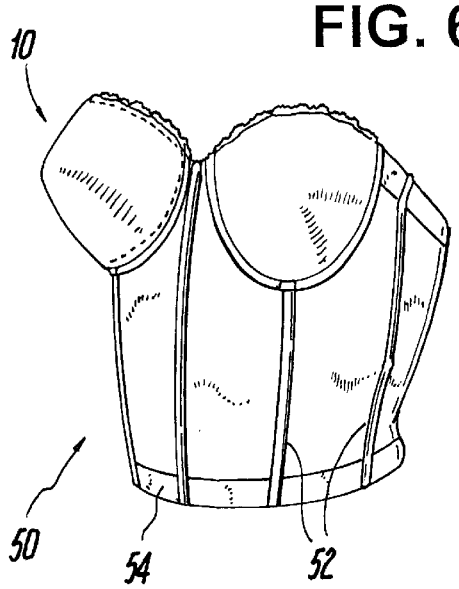
FIG. 6B
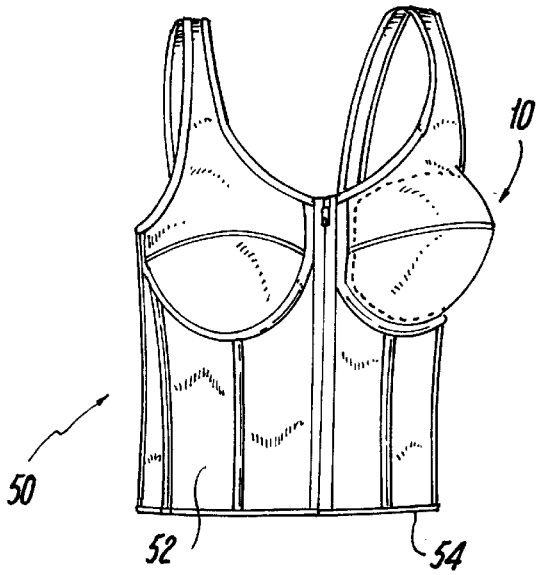
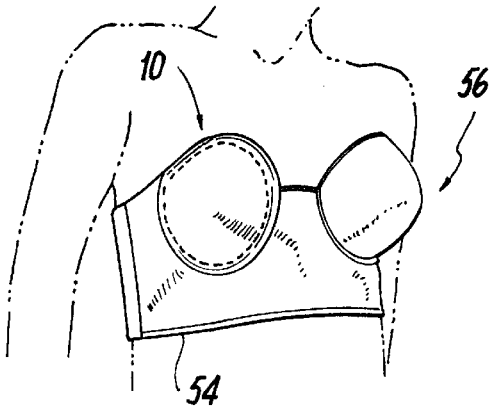
FIG. 6C
FIG. 7A
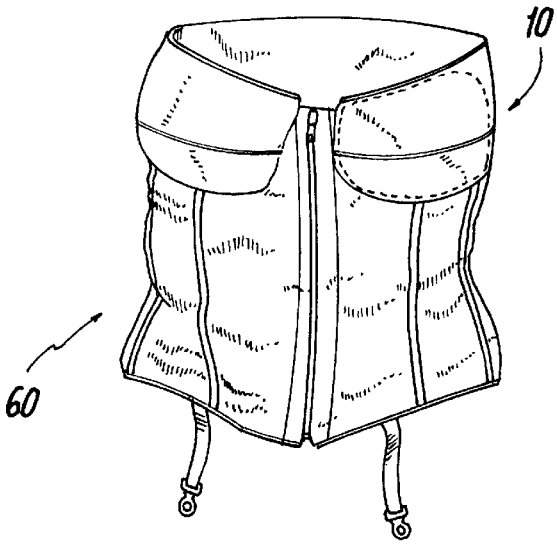

MASTECTOMY GARMENTS WITH BUILT-IN PROSTHETIC DEVICE

BACKGROUND OF THE INVENTION

1. Field of the Invention

The invention relates generally to mastectomy bras. More particularly, the invention relates to fashionable garments, including bras, dresses, bathing suits, nightgowns, etc., which include one or more built-in and non-removable prosthetic devices forming a bra cup in various shapes and sizes, complementing the size and shapes of a mastectomy patient's surgical area, and/or remaining breast portions.

2. Description of the Related Art

Various breast prosthesis are known for use by mastectomy patients. For example, U.S. Pat. No. 4,195,639 discloses an external breast prosthesis comprising a thin plastic shell of elastomeric material. The external breast prosthesis is contoured to conform to the configuration of the breast of a mastectomy patient and includes a rear peripheral edge for attachment by adhesive to the chest wall of the patient. Adhesive attached mastectomy devices are known to cause irritation to the surgical area of the woman's body to which it is applied. Also known is an artificial breast form, disclosed in U.S. Pat. No. 5,458,635, including contoured, molded breast shape layers that can be sculptured by a user to create a cosmetically acceptable appearance, i.e., fit. Use of such form, however, limits the type of garment which may be worn therewith. Further known is U.S. Pat. No. 5,855,606, which discloses a breast prosthesis comprising an underwire adapted to retain the breast prosthesis, which prosthesis may be removably attached to an unmodified bra. There are particular problems known to those skilled in the art associated with the use of bra-removable mastectomy problems.

Also known are garments constructed for use by mastectomy patients. For example, U.S. Pat. No. 4,100,621, discloses an artificial breast or mastectomy prosthesis and nightgown incorporating same. The prosthesis is constructed as a lightweight substantially breast shaped pad having hook-type fastening means at a plurality of locations about the pad which are fastenable to mating pile attachments means on the inside of a bosom area of a nightgown and readily removable therefrom. As does the '621 patented prosthesis, the '621 patented prosthetic device is constructed to be removed from the garment for storage and maintenance.

Also known is U.S. Pat. No. 4,187,855 which discloses a garment for use after breast surgery. The garment may be described as a prosthesis or bra-type garment for use after breast surgery. The garment includes enlarged arm openings and an elongated bodice portion to fit beyond the wearer's waist and assist in holding the garment in place. The breast substitute is provided in a form of a swimsuit insert, conventional padded bra of other similar device filled with a conventional padding material and attached to the garment.

Also known is U.S. Pat. No. 5,478,278 which discloses an adjustable inner breast cup insert assembly for a women's swimsuit or garment such as a leotard, dancewear, etc. The inner breast cup insert assembly comprises two breast cups connected at midsection, where each contains a vertical and side extension with fastening material such as hooks or loop-type fasteners. The fastening material of the inner breast cup assembly is connected to the fastening material of the swimsuit of garment and provides a proper fit, choice of size, proper support, comfort, shape and desired look for a particular wearer.

Also known is U.S. Pat. No. 4,699,144, which discloses a mastectomy garment including an underbra, a prosthetic breast pad and an outer bra. The underbra has a supporting cup for a normal breast and a substantially flat band portion to fit to the chest of the removed breast, enabling a firm, flat-fitting garment over the remaining chest surface of the removed breast. The prosthesis or false breast is removably adhered to the outer surface of the flat binding portion.

Because of the mental and physical shock associated with breast cancer and mastectomy procedures, it is usually a trying experience for the recovering woman to feel comfortable in prosthetic type bras and clothing available on the market today, some of which are described above. More particularly, prosthetic bras and garments for mastectomy patients available in today's market are limited and rarely provide a women in need of same with the comfort and confidence needed or desired for social interaction when dressed for the world. For that matter, most prosthesis are pre-molded, mass produced for the standard figure, not machine washable, uncomfortable, expensive and most of all, less than esthetically pleasing.

OBJECTS AND SUMMARY OF THE INVENTION

Hence, it is an object of this invention to provide a line of fashionable garments for use by mastectomy patients which overcomes the shortcomings of the prior art.

It is another object of the present invention to provide varied designs of articles of clothing, or lines of clothing which include a specialized bra cup including functioning portions which provide a mastectomy patient wearer with smooth and natural looking body line, and such that her prosthetic chest portion built into the garment has the apparent ability to flow with the other natural portions of her bosom.

And in accordance with the principles of the invention, a line of fashionable garments is provided which comprise a natural-looking and shaped prosthetic breast device permanently inserted in the garment to replace one or both breasts removed, with or without post surgery reconstruction. The garments include various shaped and sized breast cups comprising prosthesis which are permanently affixed to the garment to enable the wearer to merely dress with the garment without having to go through a process of inserting a prosthesis, affixing the prosthesis, adjusting the prosthesis, etc., normally associated with conventional prosthetic devices and garments therefor.

The bra cups, and garments comprising same, preferably comprise low maintenance outer materials, e.g., cotton, and the prosthetic device itself constructed with a semipermeable enclosure material which is not effected by conventional environmental conditions, i.e., cleaning with laundry detergents.

Applicant's invention uses combinations of particular features including a permanently adjusted liquid or filler based prosthetic bra cup, the bra cup constructed to be manufactured in garments which may be worn, washed and stored, as would be a conventional non-prosthetic bra. Prices for garments manufactured in accordance with the principles of this invention, e.g., bras, bathing suits, may fluctuate in accordance with the diversity of the line of garments, and quantity. Because of its built-in placement within the garment in which it is disposed, the bra cup portion of the garment will not cause irritation, shifting or uncomfortability. All of the inventive garments are meant to be manufactured in many styles and cup sizes to provide the woman in need with a variety of fashionable items suiting her taste in clothes.

The bra portion of any of the particular garments envisioned by the inventive concept disclosed herein includes one or both cups filled and permanently filled with a liquid or semi-liquid material, e.g., water, gel, silicone, a mixture of same, a mixture of water, silicone or gel with an additional structural matrix (in the case of larger breast sizes) and permanently sealed in an outer shell. The back of the outer shell may be encased in a comfortable fabric and disposed against the chest without adhesive or fasteners. The garments include, but are not limited to night gowns, bathing suits, evening wear, sweater, athletic wear, bras, etc., the bras including various styles such as underwire, bond style, strapless bras, brazalettes, bustiers, one piece undergarments, etc. meant to be constructed

BRIEF DESCRIPTION OF THE DRAWINGS

Preferred embodiments of the system, apparatus and method of this invention are described in detail herein with reference to the following drawings, wherein:

FIGS. 6A, 6B and 6C are schematic representations of a strapless, long-lined bra with boning, a strapped linguine bra and a strapless bra, respectively, each constructed for use with full-bodied women in accordance with the principles of this invention;

FIG. 7A is a schematic representation of a coscelette constructed for use with full-bodied women in accordance with the principles of this invention;

FIGS. 12A, 12B and 12C, respectively, are schematic representation of a two-piece bathing suit, a full swimsuit, and back inner bra and hook portion of the FIG. 12B front portion, each constructed in accordance with the principles of the invention;

DETAILED DESCRIPTION OF PREFERRED EMBODIMENTS

Figure 1:
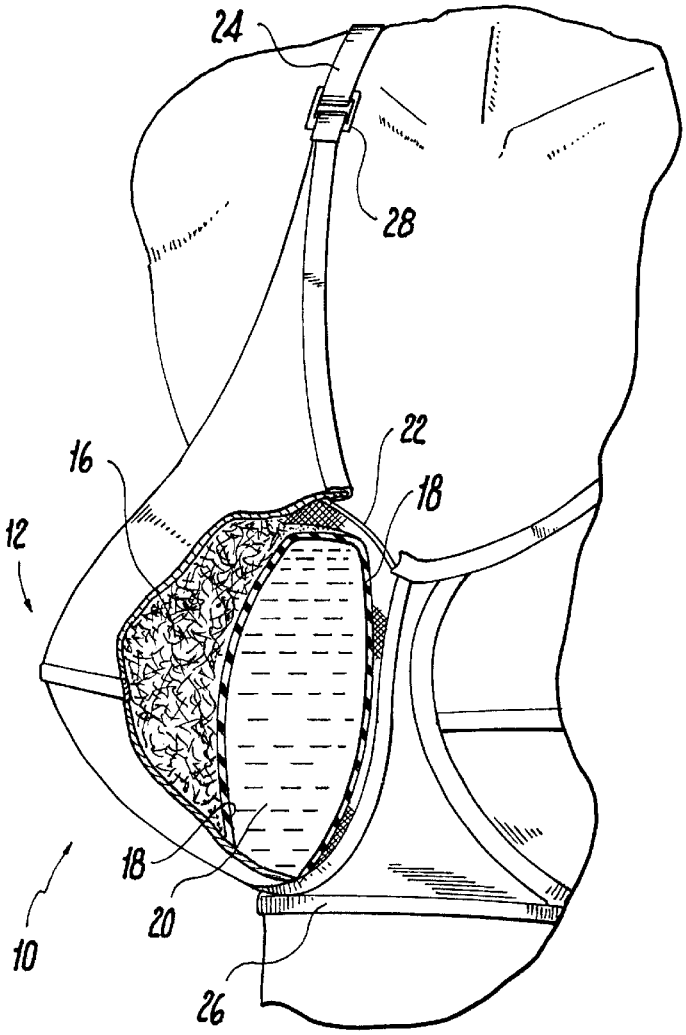
FIG. 1 is a schematic representation of one embodiment of a bra cup which may be comprise a portion of garments of the invention.

Although the subject invention has been described above, and will be described in detail below with respect to preferred embodiments, it will be readily apparent to those having ordinary skill in the art to which the invention pertains that changes and modifications may be made to the inventive bra cup and garments comprising same without departing from the spirit or scope of the subject invention, limited only as interpreted by the scope of the appended claims.

A line of fashionable garments is provided which comprises a natural-looking and naturally shaped prosthetic bra cup or breast device, fixedly disposed within each garment. The bra cup is, constructed in accordance with the inventive concept taught herein. Inclusion of a bra cup as shown herein renders the garment constructed therewith capable of replacing the aesthetic presence and function of one or both breasts, some time after their required removal by surgery (with or without post surgery reconstruction). The garments are constructed to be "wash and wear." In particular, the garments contemplated by the present invention include a front portion 12 composed of any fabric known to those skilled in the art which could render the herein described construction possible. For example, various textured and colored cottons, laces, satins, etc. Of course, though particular fabrics may require particular type garment protection. The filler may be added to reduce the amount of fluid necessary for the prosthetic device. For example, larger cup bra's such as C, D, E, F may require a lesser ratio of fluid-like material to filler. A fabric backing 22, e.g., cotton, is permanently affixed to a back portion of seal 18 to complete the bra cup 10. For that matter, the purpose of the fabric backing is for breathability in the portion contacting the user's chest, minimizing any discomfort during extended wear periods. Front and back portions may be composite parts or formed as one piece. In its composite form, the front and back may meet at or proximate strap 24 at upper portion of the prosthetic device (18 and 20), and the proximate bottom band 26. Preferably, the strap 24 is connected to bra cup 10 via connector 28.

The shape of prosthetic device (i.e., lining 18 and fluid-like material 20) and fiber filling 16 may be varied in accordance with the shape of the woman choosing to wear a garment within which the bra cup 10 is incorporated. While the prosthetic device is flexible and therefore may not maintain its breast-like shape when not being worn in whatever garment it is incorporated (e.g., bra, formal wear, dance wear, bathing suit, nightgown, etc.), when worn and pressed against the users chest, it naturally takes the breast-like form. The ratio of fiber filler 16 to fluid-like material 20 may be used to vary the shape and substance of the complete bra cup 10. For example, the ratio may be varied based upon the extent of the surgical procedure, that is, the surgical breast area to which the fabric backing 22 will come into contact during use. This is required where those utilizing the bra cup 10 may have had a reconstructive surgery, or partial mastectomy, and is able to provide for a significant tissue volume at and around the surgical area. Where adjustments to the size of the cup which stand outside those standards or specifications which could define a standard, a special embodiment may include a valve 15 (shown in the embodiments of FIGS. 14 and 15, but not explicitly shown in FIG. 1) for adding to or removing from the volume of inner material 20.

The form of the embodiment of bra cup 10 of FIG. 1 may be varied by excluding a fiber portion 16 with larger prosthetic device (material 20 enclosed with 18). That is, portion 20 becomes a fiber material 20'. Fiber material 20' may be varied to include a fluid like material throughout a fiber matrix. Where having an adjustably bra cup size would be useful, a form which includes a valve 28. The valve is included to add and remove fluid- and/or gas-like material from the mass of material 20. This provides a means for adjusting the prosthetic device weight, size, shape, firmness, texture etc. The liner 18 must be made of a non-permeable material to prevent, detergents, food materials, etc. from passing into the prosthetic device while wearing a garment fitted with same. The fluid-like material may be varied in volume at manufacture (and in some models, adjustable) to vary the weight and firmness of the device for a wearer physical characteristics.

The bra cup 10 of FIG. 1 may be constructed for use in "regular bras", or any other line of garments such as mentioned broadly above. Of course, bra cup 10 may be fitted for single, double, or partial mastectomy survivors.

Figure 2:
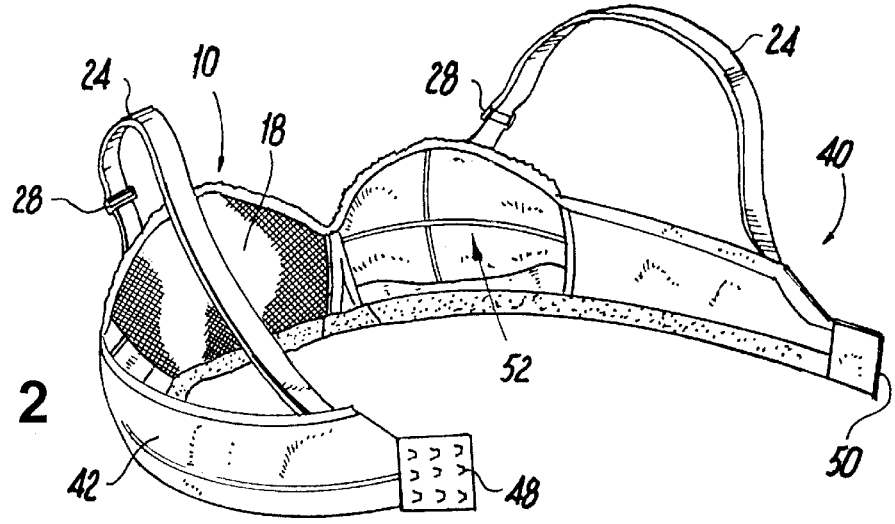
FIG. 2 is a schematic representation of a bra constructed in accordance with the principles of this invention.

FIG. 2 is a schematic representation of a bra 40 constructed in accordance with the principles of the bra cup 10 set forth above with respect to FIG. 1. Bra 40 includes bra cup 10 connected by hooks 28 to strap 24 and wraparound support material 42. A regular (Non-mastectomy) cup 52 is also shown, this bra designed for use by a woman who had her left breast removed or partially removed. Bra 40 closes in the back with clasp 48 and hook section 50. The wrapping or holding ability of the bra 40 determines both its comfortability to the wearer, and its aesthetic and ability to flow with the other natural portions of the body.

Figure 3:
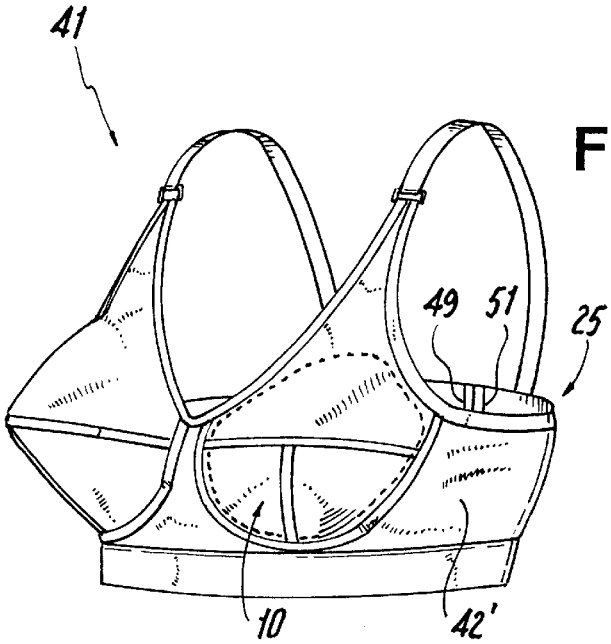
FIG. 3 is a schematic representation of a bra constructed for use with full-bodied women in accordance with the principles of this invention.

FIG. 3 is a schematic representation of a bra 41 constructed for use with full-bodied women in accordance with the principles of this invention. The bra 41 includes a bra cup 10 as described above, bra backing 42', which may be "boned" or underwire supported, comprises an upper back portion 25 closing with detachable portions 49, 51.

Figure 4:
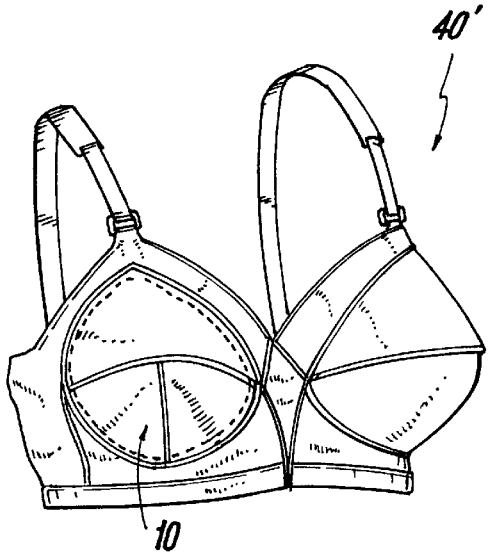
FIG. 4 is a schematic representation of a regular underwire bra constructed with the a back hooking mechanism in accordance with the principles of this invention.

FIG. 4 is a schematic representation of a regular underwire bra 40' constructed with the a back hooking mechanism (not shown in the figure) and a bra cup 10 constructed in accordance with the principles of this invention.

Figure 5:
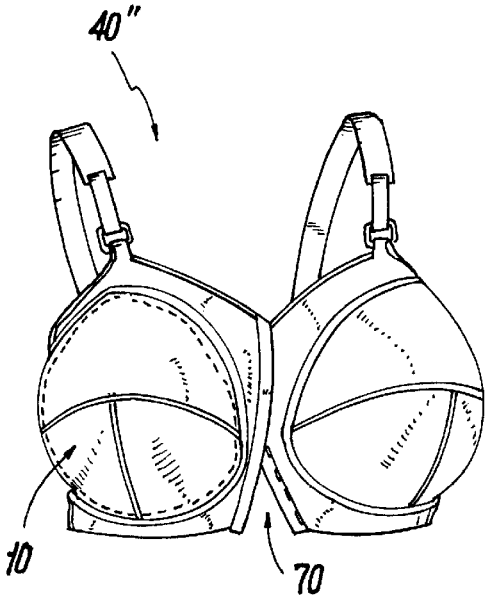
FIG. 5 is a schematic representation of a regular underwire bra constructed with a front hooking mechanism in accordance with the principles of this invention.

FIG. 5 is a schematic representation of a regular underwire bra 40" constructed with the a front hooking mechanism 70 and a bra cup 10 constructed in accordance with the principles of this invention.

FIG. 6A shows a strapless, long-lined bra 50, with boning 52, waistband portion 54 and bra cup 10 constructed in accordance with the principles of this invention.

FIG. 6B shows an adjustable strap long line bra 50 (without boning), with elastic side panels 52, elastic waistband portion 54 and bra cup 10 constructed in accordance with the principles of this invention.

FIG. 6C shows a strapless bra 56 with waistband portion 54 and bra cup 10 constructed in accordance with the principles of this invention. This (and for that matter any bra or bra cup set forth herein) may be constructed with or without underwire.

FIG. 7A is a schematic representation of a brasellette with boning or underwire 60 constructed for use with the bra cup 10 constructed in accordance with the principles comprising bra cups 10 and 10' described above.

Figure 7B:
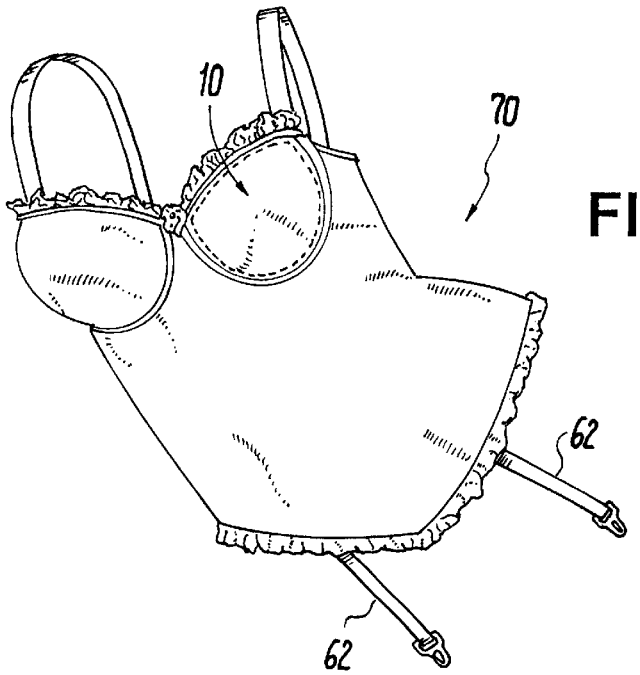
FIG. 7B is a schematic representation of a one piece brasellette, with short leg garters, constructed in accordance with the principles of this invention.

FIG. 7B is a schematic representation of a one piece briefer 70, with short leg garters 62, and a bra cup portion 10 constructed in accordance with the principles of this invention.

Figure 8A:
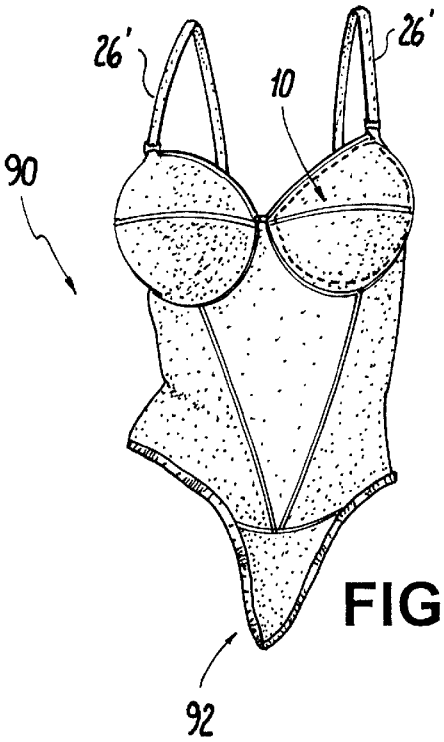
FIGS. 8A and 8B are schematic representations of a long-line briefer, garter type bra with adjustable straps, and short-leg long-line briefer, without garters and including a cotton-lined panty panel, respectively, each constructed in accordance with the principles of the invention.
Figure 8B:
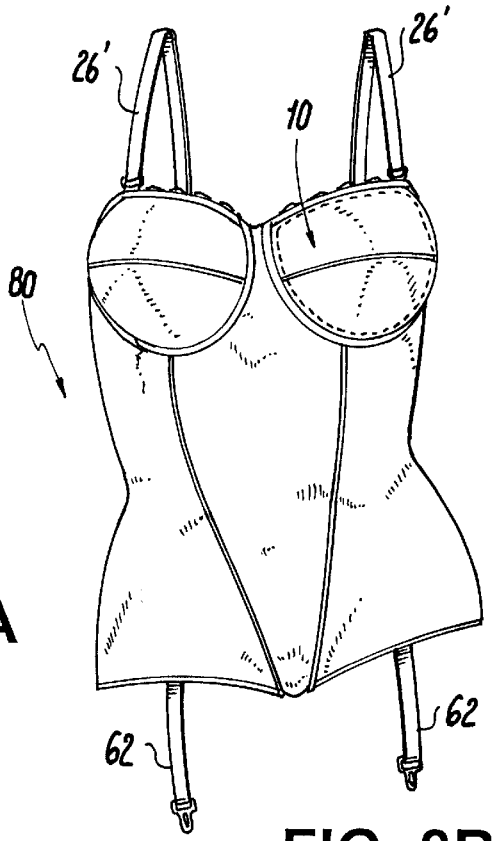

FIGS. 8A and 8B are schematic representations of a long-line briefer 90 and garter type bra 80 with adjustable straps 26' and garters 62; and short-leg long-line briefer 90 ( without garters) and including a cotton-lined panty panel 92, respectively, each also including a bra cup 10 constructed in accordance with the principles of this invention.

Figure 9A:
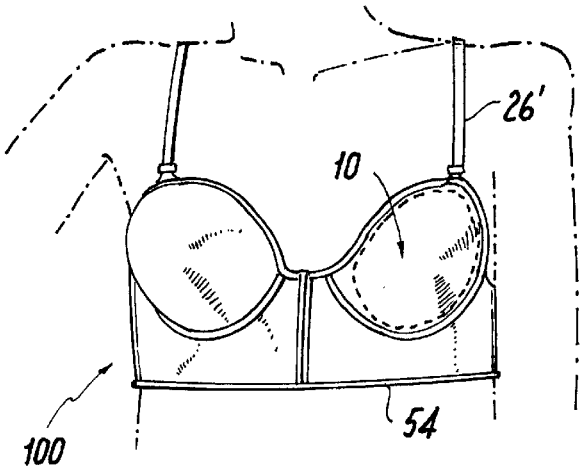
FIGS. 9A and 9B are schematic representations of a regular bra, with band bottom and adjustable straps, and a long-line, front hook bra with adjustable straps, respectively, each constructed in accordance with the principles of the invention.
Figure 9B:
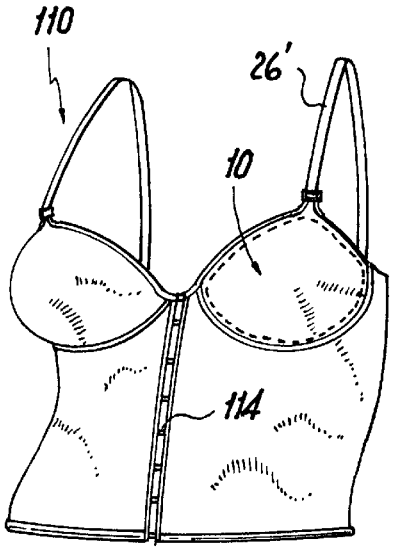

FIGS. 9A and 9B are schematic representations of a regular bra 100, with band bottom 54 and adjustable straps 26'; and a long-line, front hook bra 110 with adjustable straps 26 and front hook 114, respectively, each including at least one bra cup 10 constructed in accordance with the principles of the invention.

Figure 10A:
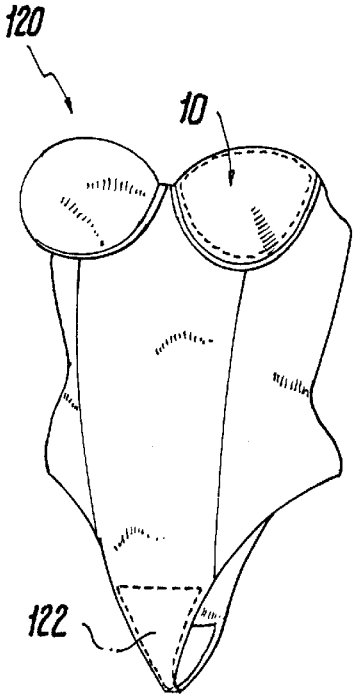
FIGS. 10A and 10B are schematic representations of a strapless, short leg briefer bra, including a cotton-lined panty portion, and a long-line briefer pantyleg with lined panty panel and front cut fabric opening in the panty panel, respectively, each constructed in accordance with the principles of the invention.
Figure 10B:
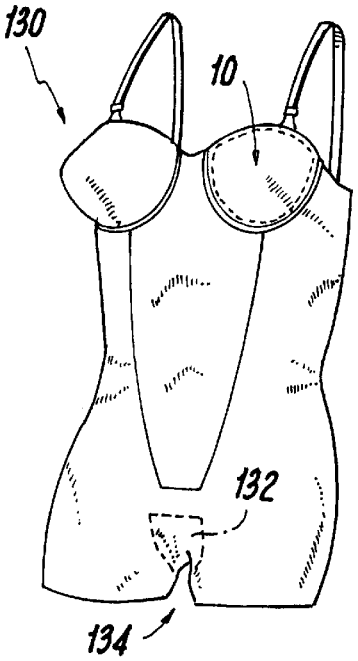
Figure 11A:
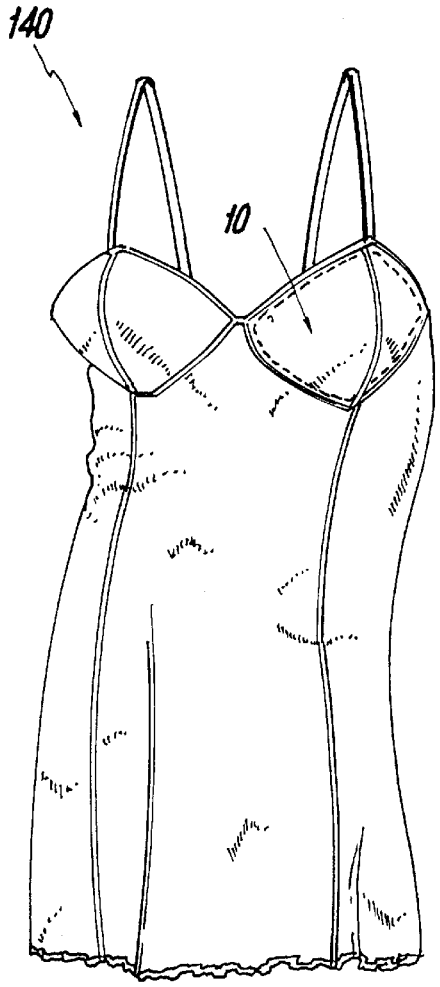
FIGS. 11A and 11B are schematic representations of a baby doll spaghetti strap bra insert, and long night gown bra insert, respectively, each constructed in accordance with the principles of the invention.
Figure 11B:
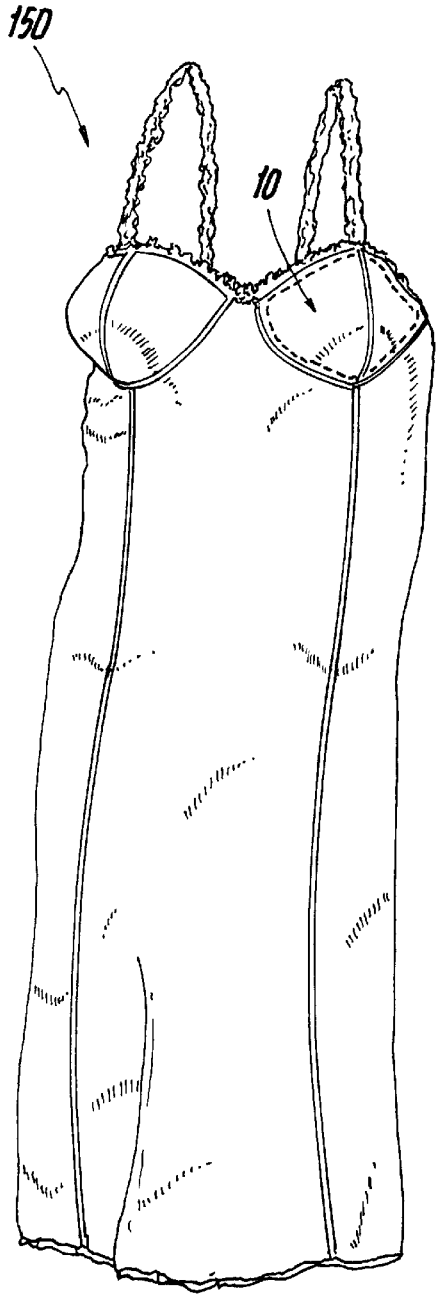
Figure 12C:
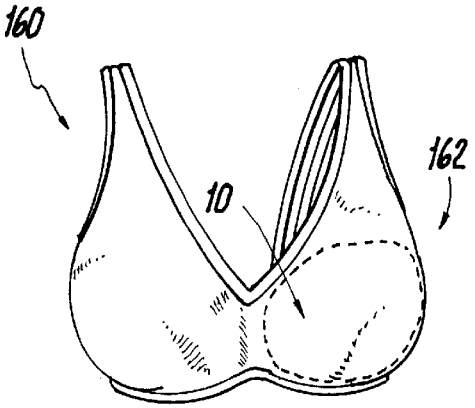
Figure 12C:
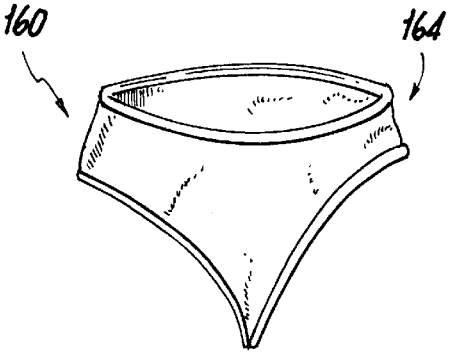
Figure 12C:
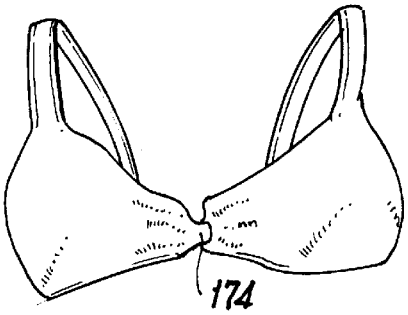
Figure 12B:
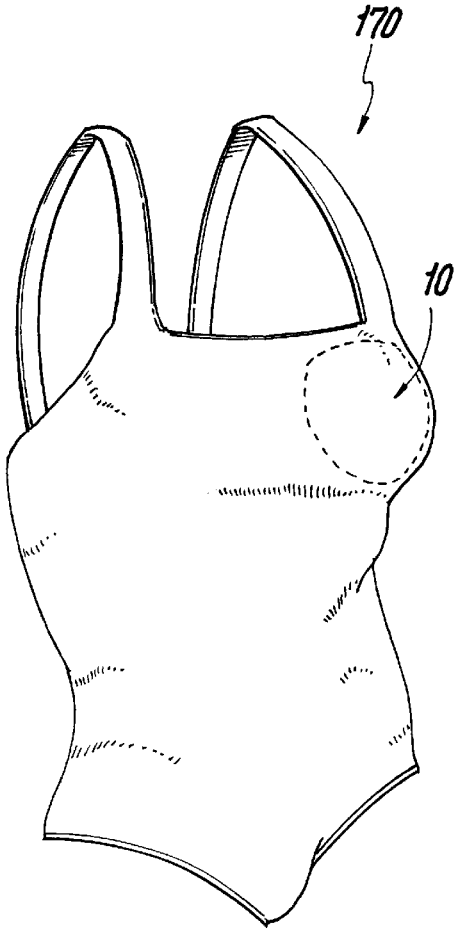
Figure 13:
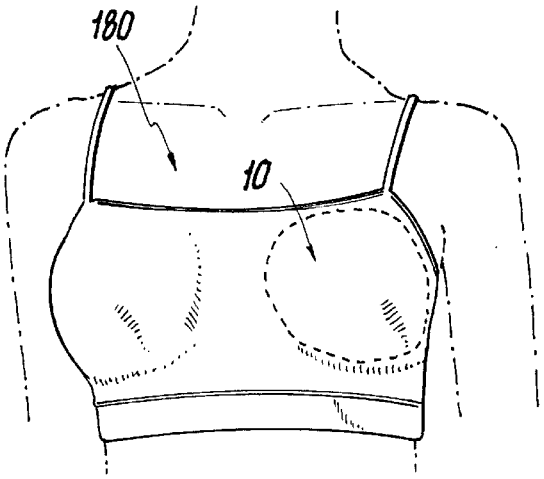
FIG. 13 is a schematic representation of an athletic bra constructed in accordance with the principles of the invention.

FIGS. 10A and 10B are schematic representations of a strapless, short leg briefer bra 120, including a cotton-lined panty portion 122; and a long-line briefer pantyleg bra 130 with lined panty panel 132 and front cut fabric opening 134 in the panty panel, respectively, each including bra cups 10 constructed in accordance with the principles of the invention FIGS. 11A and 11B are schematic representations of a baby doll spaghetti strap bra insert 140, and long night gown bra insert 150, respectively, each including a bra cup 10 constructed in accordance with the principles of the invention FIGS. 12A1 and 12A2 comprise a schematic representation of a two-piece bathing suit 160, comprising top and bottom portions 162, 164. FIG. 12B represents a full swimsuit 170, and back inner bra (FIG. 12C) and hook portion 174. FIG. 13 is a sports bra 180. Each of the garments of FIGS. 12A–12C, and the sports bra of FIG. 13 includes bra cups 10 constructed in accordance with the principles of the invention.

Each of the bra cups, or clothing apparel same disclosed herein, may be constructed with regular adjustable straps or stretch straps. Wider, padded straps should be made available for larger cup sizes.

Figure 14:
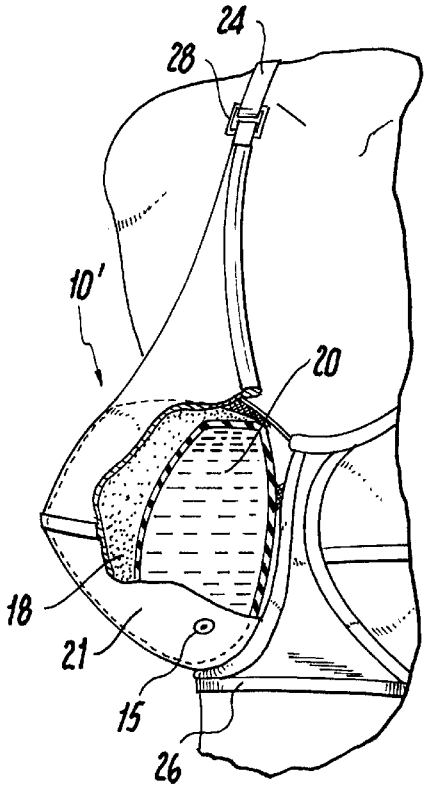
FIG. 14 is a schematic representation of a bra cup constructed in a distinct form from the embodiment of the bra cup depicted in FIG. 1 herein.

FIG. 14 is a schematic representation of a bra cup 10' constructed in a form which is unique from the form of the embodiment of the bra cup depicted in FIG. 1 herein. That is, bra cup 10' comprising a prosthetic device portion 21 for insertion into garments which allow use of a full prosthetic device. The portion 21 comprises a fluid-like filler material 20, typically a liquid, gas, gel, etc. The bra cup may be attached via connector 28 to an upper strap 24 and to a lower strap or waist band 26. Moreover, in a variation of the FIG. 14 embodiment, a valve 15 may be included for use under conditions in which fluid material 20 may be required to be added or removed from the bra cup in order to adjust the aesthetic size and shape of same. For certain cup sizes, it may be effective to include a matrix of some type of honeycomb-like material within the fluid-filled portion 20 in order to manufacture the cup with less fluid, thereby lowering its weight while maintaining its flexible breast-like shape, in any of bra cups 10. 10', 10", and other variations thereof. Moreover, the matrix or honeycomb-like filler should preferably perform a baffle-like function to avoid undamped fluid movement within filled portions 20, rendering the prosthetic device more like a natural breast.

Figure 15:
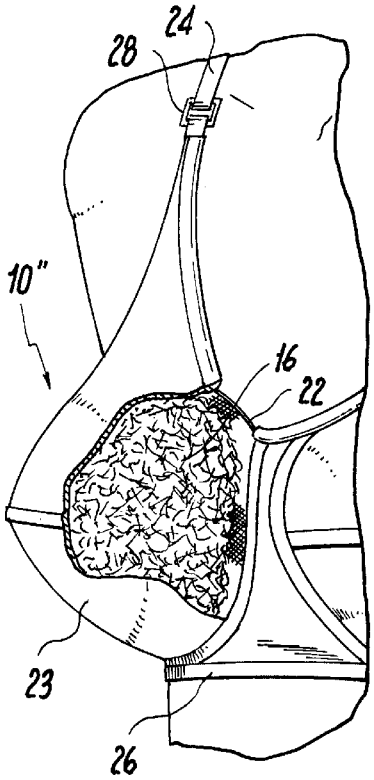
FIG. 15 is a schematic representation of a bra cup constructed in a distinct form from the embodiment of the bra cup depicted in FIG. 1 herein.

FIG. 15 is a schematic representation of a bra cup 10" constructed in a form which is unique from the form of the embodiment of the bra cups depicted in FIGS. 1 and 14 herein. That is, bra cup 10" comprises a prosthetic device portion 23 for insertion into garments which allow use of a full prosthetic device. The portion 21 comprises a filler material 16, typically any useable filler material known to those skilled in the art, e.g., cotton fiber, acrylic fiber, etc. The bra cup may be attached via connector 28 to an upper strap 24 and to a lower strap or waist band 26.

Figure 16:
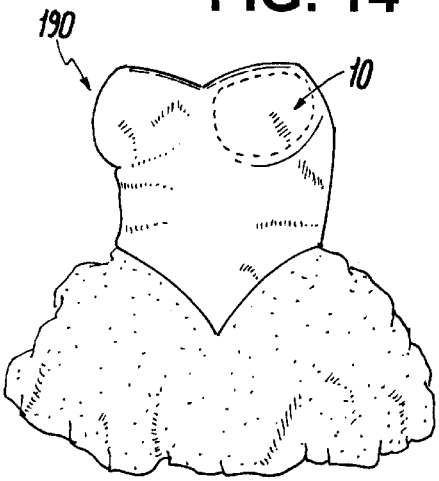
FIG. 16 is a schematic representation of dancewear constructed in accordance with a bra cup of the invention.

FIG. 16 is a schematic representation of a dancewear garment 190 which includes a bra cup 10 constructed in accordance with the principles of the present invention.

While the several embodiments depicted in the drawing figures and described hereinabove clearly describe the inventive concept of the present invention, they are set forth for exemplary purposes only. One skilled in the art will understand that various modifications may be made thereto without departing from the scope and spirit of the invention, limited only by the scope of the claims set forth below.

What is claimed is:

1. A mastectomy bra constructed with a built-in prosthetic device, comprising at least one bra outer portion within which a breast-shaped prosthetic device of varying weight and composition is permanently positioned and sealed, wherein said at least one bra cup further comprises:

an outer fabric layer fully enclosing and supporting said prosthetic device, said outer fabric layer including a breast contoured portion and a body facing portion; and said prosthetic device formed in a natural shape of a woman's breast and constructed of a non-permeable, soft flexible outer shell layer within which is disposed one of a fluid-like material, a gaseous material and a combination of fluid and gaseous materials surrounding a fiber matrix.

2. A bra cup for use in womens apparel constructed for women who have undergone mastectomy surgery said bra cup comprising:

a finished front portion of the bra;

a special lining;

a filler material; said filler material being soft and washable and constructed of a hone comb-like matrix and surrounded by the special lining to form and maintain a breast-like shape;

a prosthetic lining surrounding and hermetically sealing a fluid-like material, wherein said filler material fluid-like material and linings comprise a prosthetic device; and a fabric backing permanently affixed to the finished front portion with a strap at an upper portion of the prosthetic device, and a proximate bottom band.

3. The bra of claim 1, wherein said fluid-like material is one of silicone, water, air and gels, and mixtures thereof.

4. The bra cup of claim 2, wherein said fluid-like material is one of silicone, water, air and gels, and mixtures thereof.

5. The bra cup of claim 2, wherein said finished front portion comprises at least one of man-made and natural fiber fabric.

6. The bra cup of claim 3, wherein said front portion is one of a group consisting of colored cottons, laces and satins.

7. The bra of claim 3, wherein a filler is added to the breast to reduce the amount of fluid necessary to form the prosthetic device.

8. The bra cup of claim 2, wherein the shape of prosthetic device is varied in accordance with the shape of the user.

9. The bra cup of claim 2, wherein a ratio of filler to fluid-like material is varied to vary a matrix structure realized by inclusion of said filler with said fluid-like material.

10. The bra cup of claim 8, wherein a valve is included to facilitate addition and removal of fluid-like material from the prosthetic device.

11. The bra cup of claim 2, wherein the liners are made of a non-permeable material to prevent, detergents, food materials, etc., from having a deleterious effect upon the fiber and fluid-like material the lining surrounds.

12. The bra cup of claim 2, wherein bra cup is constructed into garments fitted for single, double, partial mastectomy survivors.

13. A garment including a built-in prosthetic bra cup, the prosthetic bra cup comprising:

a finished front portion of the bra;

a special lining forming a prosthetic device which is permanently affixed within the bra cup;

a honeycomb-like matrix; said honeycomb-like matrix being soft and washable included within the special lining to provide a basic form of the prosthetic device, the prosthetic lining surrounding and hermetically sealing a fluid-like material distributed throughout said matrix; and a fabric backing permanently affixed to the finished front portion with a strap at an upper portion of the prosthetic device, and a proximate bottom band, wherein varying a ratio of matrix to fluid-like material varies the aesthetic look of said garment on a wearer.

14. The garment of claim 13 chosen from a group consisting of: a bathing suit, a night gown, evening wear, leisure wear and dance wear.

* * * * *